US007107786B2

(12) United States Patent
Manole

(10) Patent No.: US 7,107,786 B2
(45) Date of Patent: Sep. 19, 2006

(54) APPARATUS FOR AND METHOD OF VENTING HYDROCARBON REFRIGERANT LEAKS

(75) Inventor: Dan M Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 115 days.

(21) Appl. No.: 10/987,752

(22) Filed: Nov. 12, 2004

(65) Prior Publication Data

US 2006/0101843 A1 May 18, 2006

(51) Int. Cl.
*F25D 17/06* (2006.01)

(52) U.S. Cl. ..... 62/426; 62/419

(58) Field of Classification Search ..... 62/263, 62/411, 419, 426, 450
See application file for complete search history.

(56) References Cited

U.S. PATENT DOCUMENTS

| | | | | | |
|---|---|---|---|---|---|
| 2,053,453 | A | | 9/1936 | Wendler | 98/51 |
| 2,173,150 | A | | 9/1939 | Blackstrom | 62/89 |
| 2,290,190 | A | | 7/1942 | Jacobs | 62/89 |
| 2,378,524 | A | | 6/1945 | Yerkes | 62/116 |
| 2,393,238 | A | | 1/1946 | Dailey | 62/89 |
| 2,446,876 | A | | 8/1948 | Iwashita | 62/115 |
| 2,469,179 | A | | 5/1949 | Schultze | 62/119.5 |
| 2,579,056 | A | | 12/1951 | Thompson | 62/117.4 |
| 2,881,600 | A | | 4/1959 | Elfving | 62/239 |
| 3,125,864 | A | | 3/1964 | Ural | 62/256 |
| 3,263,745 | A | | 8/1966 | Henry | 165/48 |
| 3,330,131 | A | | 7/1967 | Papst | 62/455 |
| 3,759,059 | A | | 9/1973 | Kenyon | 62/246 |
| 4,019,339 | A | * | 4/1977 | Anderson | 62/255 |
| 4,089,187 | A | | 5/1978 | Schumacher et al. | 62/289 |
| 4,509,339 | A | * | 4/1985 | Mehlan et al. | 62/450 |
| 4,593,538 | A | | 6/1986 | Borde et al. | 62/490 |
| 4,920,764 | A | * | 5/1990 | Martin | 62/259.1 |
| 5,117,523 | A | | 6/1992 | Jacobus et al. | 62/259.1 |
| 5,154,066 | A | * | 10/1992 | Choi | 62/429 |
| 5,347,827 | A | | 9/1994 | Rudick et al. | 62/440 |
| 5,402,654 | A | | 4/1995 | Rudick et al. | 62/448 |
| 5,428,973 | A | | 7/1995 | Temmyo et al. | 62/452 |
| 5,660,051 | A | | 8/1997 | Sakakibara et al. | 62/133 |
| 6,073,455 | A | | 6/2000 | Tachigori et al. | 62/129 |
| 6,085,531 | A | | 7/2000 | Numoto et al. | 62/149 |
| 6,202,435 | B1 | | 3/2001 | Fujitaka et al. | 62/331 |
| 2002/0178738 | A1 | | 12/2002 | Taira et al. | 62/129 |
| 2002/0194862 | A1 | | 12/2002 | Komatsubara et al. | 62/474 |

* cited by examiner

*Primary Examiner*—Melvin Jones
(74) *Attorney, Agent, or Firm*—Baker & Daniels

(57) ABSTRACT

A hydrocarbon cooling system including a housing having a substantially rectangular base defining a diagonal, a front wall defining a first air inlet, a back defining a first air outlet, and a pair of side walls. The cooling system includes a condenser mounted within the housing adjacent the first air inlet; a compressor; an evaporator; and a fan mounted within the housing and defining an axis. The fan is positioned such that a vertical plane aligned along the axis defines a first a non-perpendicular angle relative to a second vertical plane aligned perpendicular to the back of the housing. The fan creates a first horizontal airflow path, which enters the housing through the first air inlet and exits the housing through the first air outlet. The first horizontal airflow path induces a second horizontal airflow, which moves around the housing along a line substantially parallel to the diagonal.

23 Claims, 10 Drawing Sheets

APPARATUS FOR AND METHOD OF VENTING HYDROCARBON REFRIGERANT LEAKS

BACKGROUND OF THE INVENTION

1. Field of the Invention

The present invention relates to refrigeration systems, particularly refrigeration systems that use hydrocarbon refrigerants and means for venting hydrocarbon refrigerant leaks.

2. Description of the Related Art

Refrigerators commonly include an insulated cabinet, the interior of which is cooled by a cooling system. The cooling system is typically disposed within a housing, which is located beneath or behind the cabinet. The cooling system generally includes a compressor; a condenser fluidly connected to the compressor; and an evaporator fluidly connected to both the compressor and the condenser and in thermal communication with the interior of the cabinet. In operation, a refrigerant gas enters the compressor where it is compressed under high pressure. The compressed refrigerant gas then flows to the condenser where it is cooled in a series of coils and is condensed into a liquid. The liquid refrigerant then flows to the evaporator where the liquid refrigerant absorbs heat from the interior of the cabinet, thereby cooling the interior and converting the refrigerant liquid back to a gas. The refrigerant gas then flows back to the compressor where the cycle is repeated. A fan is typically incorporated in the cooling system to cool the compressor and force air through the condenser coils.

An effective refrigerant should be capable of readily evaporating at low temperatures and compressing at high pressure without decomposing. Consequently, compounds that are ideal for use as refrigerants are stable compounds having low evaporation temperatures. In the past, CFCs (chlorofluorocarbons) have been used as refrigerants. However, it is believed that CFCs are harmful to the environment and, as a result, hydrocarbon refrigerants, such as propane and isobutanes, have been used in place of CFCs. Unfortunately, hydrocarbon refrigerants have a Low Flammability Limit, which means that even a small hydrocarbon refrigerant leak in the housing could result in a build up of hydrocarbon refrigerant to a concentration level above the Low Flammability Limit. A concentration of hydrocarbon refrigerant above the Low Flammability Limit is sufficient to trigger an explosion in the presence of oxygen and a flame or spark.

Hydrocarbon refrigerant leaks are, to some degree, flushed from the housing by the fan. The fan, often referred to as the condenser blower, is typically located behind the condenser near the back of the housing. The fan is typically positioned such that its axis is perpendicular to the back of the housing. The fan draws air in through the front of the housing, over the condenser coils and out through the back of the housing. This airflow path may not reach the compressor and, thus, may not sufficiently cool the compressor. In addition, the air flows perpendicular to the back of the housing such that, when the air reaches the building wall behind the refrigeration system, it is deflected in both the upward and downward directions. The air that is forced upward flows up above the cabinet and ultimately mixes with the ambient air above the cabinet. However, the air that is forced downward flows beneath the housing and back to the front of the housing, where it may then be drawn back into the housing. Consequently, any hydrocarbon refrigerant contained within this air is re-circulated back into the housing, thereby permitting the accumulation of hydrocarbon refrigerant, possibly to a level above the Low Flammability Limit.

Attempts have been made to prevent hydrocarbon refrigerant leaks by reducing the number of joints in the condenser, where leaks are most likely to occur. In addition, the operating pressure may be reduced in an effort to prevent hydrocarbon refrigerant leaks. Attempts have also been made to develop systems for detecting hydrocarbon refrigerant leaks. Such systems may monitor the thermal dynamic parameters of the system and/or the electrical consumption of the compressor, or may sense the molecules of hydrocarbon refrigerant in the air. Despite these attempts, a need remains for a system that ventilates the cooling system area to effectively flush, dissipate and dilute hydrocarbon refrigerant leaks from the housing.

SUMMARY OF THE INVENTION

The present invention provides a hydrocarbon cooling system including a housing having a substantially rectangular base defining a diagonal, a front wall defining a first air inlet, a back defining a first air outlet, and a pair of side walls. The cooling system includes a condenser mounted within the housing adjacent the first air inlet; a compressor mounted within the housing; an evaporator mounted within the housing; and a fan mounted within the housing and defining an axis. The fan is positioned such that a vertical plane aligned along the axis defines a first a non-perpendicular angle relative to a second vertical plane aligned perpendicular to the back of the housing. The fan creates a first horizontal airflow path, which enters the housing through the first air inlet of the front wall and exits the housing through the first air outlet of the back of the housing to vent the condenser. The first horizontal airflow path induces a second horizontal airflow, which moves around the housing along a line substantially parallel to the diagonal.

The present invention also provides a hydrocarbon cooling system including a housing having a substantially rectangular base, a front wall extending upwardly from the base and defining a first air inlet and a second air inlet, a back defining a first air outlet, a first sidewall extending upwardly from the base and defining a second air outlet, and an opposite second sidewall extending upwardly from the base. A condenser is mounted within the housing adjacent the first air inlet. A compressor is mounted within the housing adjacent both the second air inlet and the second air outlet. An evaporator is mounted within the housing. A fan is mounted within the housing and defines an axis. The fan creates a first horizontal airflow path, which enters the housing through the first air inlet and exits the housing through the first air outlet to vent the condenser. A partition is mounted within the housing and extends upwardly from the base. The partition extends from the front wall between the first and second air inlets to the first sidewall, wherein the partition encloses the compressor and isolates the compressor, the second air inlet and the second air outlet, collectively, from the condenser, the first air inlet and the first air outlet.

The present invention further provides a method of venting hydrocarbon refrigerant leaks from the housing of a hydrocarbon cooling system having a compressor disposed within the housing, a condenser disposed within the housing and spaced apart from the compressor, and an evaporator disposed within the housing. The method includes the step of creating a first airflow path through the housing by mounting a fan within the housing. The first airflow path enters the housing through an air inlet located in the front of the housing and exits the housing through an air outlet located in the back of the housing. The method further includes the steps of venting the condenser by positioning the condenser adjacent the air inlet and in the first airflow path; and inducing a second airflow path about the housing by positioning the fan such that an axis of the fan lies along a vertical plane defining a first non-perpendicular angle relative to a second vertical plane aligned perpendicular to a back of the housing. The second airflow path moves along a line non-perpendicular to the housing.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 2:
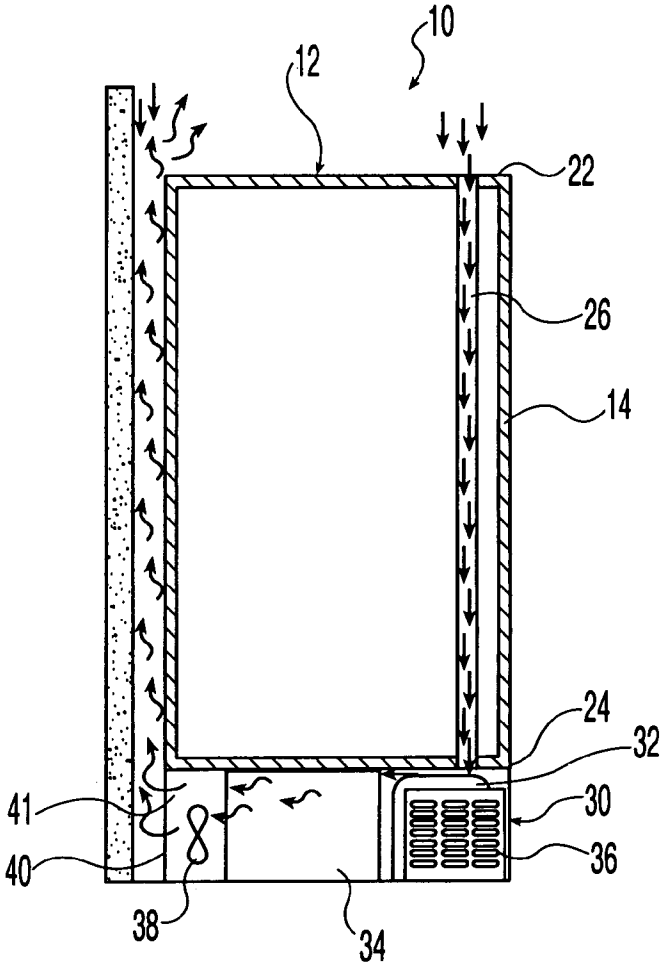
FIG. 2 is a side sectional view of a refrigeration system of FIG. 1 taken along line 2—2 in FIG. 1.
Figure 1:
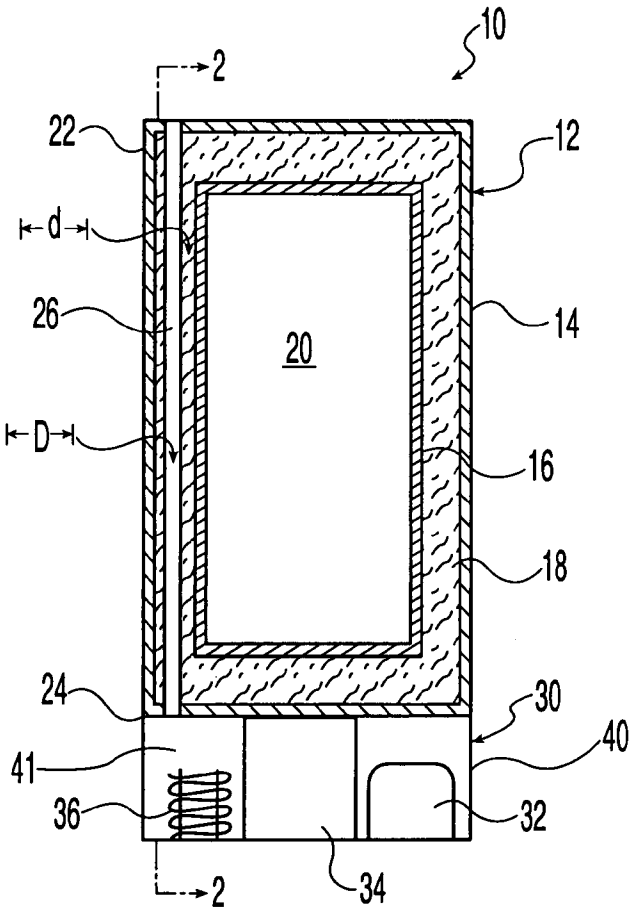
FIG. 1 is a front sectional view of a refrigeration system in accordance with the present invention.

Referring first to FIGS. 1 and 2, refrigeration system 10 according to the present invention generally includes cooling system 30 and cabinet 12. Cabinet 12 includes outer wall 14, inner wall 16 and insulative material 18 disposed between outer and inner walls 14 and 16. Inner wall 16 defines insulated interior 20, which is cooled by cooling system 30. Cooling system 30 is located within housing 40, which is positioned beneath cabinet 12. Cooling system 30 generally includes compressor 32; condenser 36, which is fluidly connected to compressor 32; evaporator 34, which is fluidly connected to both compressor 32 and condenser 36 and is in thermal communication with cabinet interior 20; and fan 38.

Figure 4:
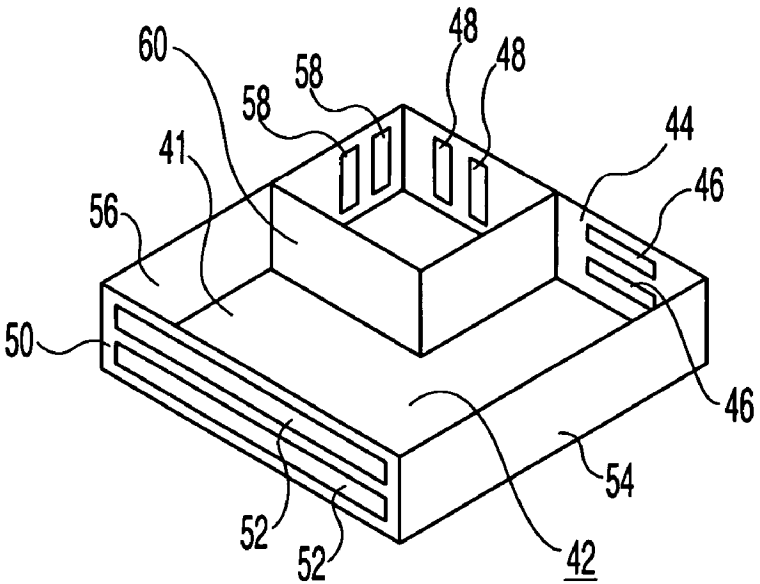
FIG. 4 is a top perspective view of the housing of the cooling system of FIG. 3.
Figure 3:
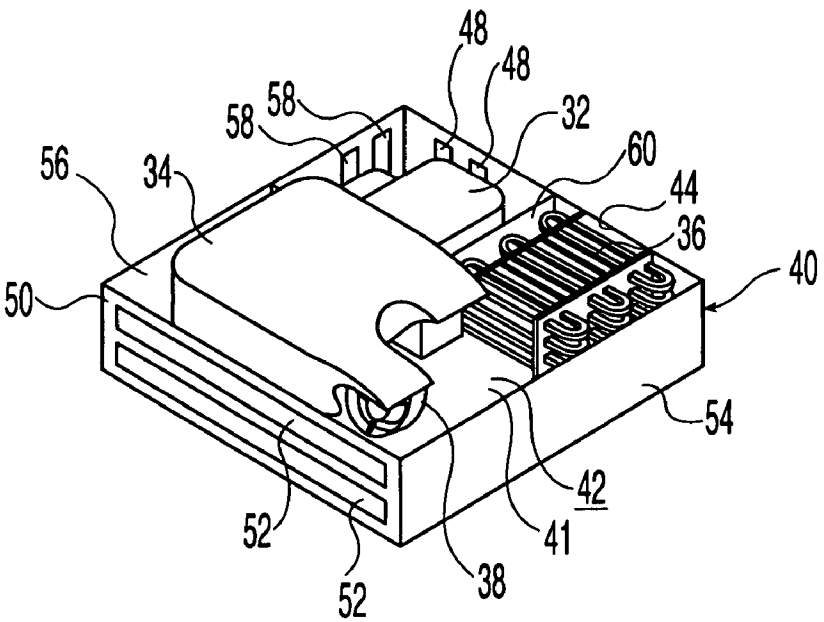
FIG. 3 is a top perspective view of a cooling system in accordance with the present invention.

Referring now to FIGS. 3 and 4, compressor 32, condenser 36, evaporator 34, and fan 38 are contained within housing 40. Housing 40 is substantially rectangular and includes base 42, front wall 44, back 50, and pair of sidewalls 54, 56, all of which cooperate to define interior space 41. Front wall 44 includes first air inlet 46 through which air from outside housing 40 can enter space 41. Condenser 36 is positioned adjacent first air inlet 46 such that the cool ambient air drawn into space 41 through first air inlet 46 flows over the coils of condenser 36, thereby aiding in the cooling and condensing of the hydrocarbon refrigerant contained within the coils. Back 50 includes first air outlet 52 through which air can exit space 41. It should be understood that first air outlet 52 need not be a slot defined in a back wall as depicted in FIGS. 3 and 4. Instead, back 50 can be open to the space outside housing 40 such that nearly the entirety of back 50 can serve as first air outlet 52. In addition, first air inlets 46 need not be horizontal slots defined in front wall 44. Instead, first air inlets 46 may be any shape, size, or design that will allow air to flow into housing 40, for example, vertical slots.

Figure 6:
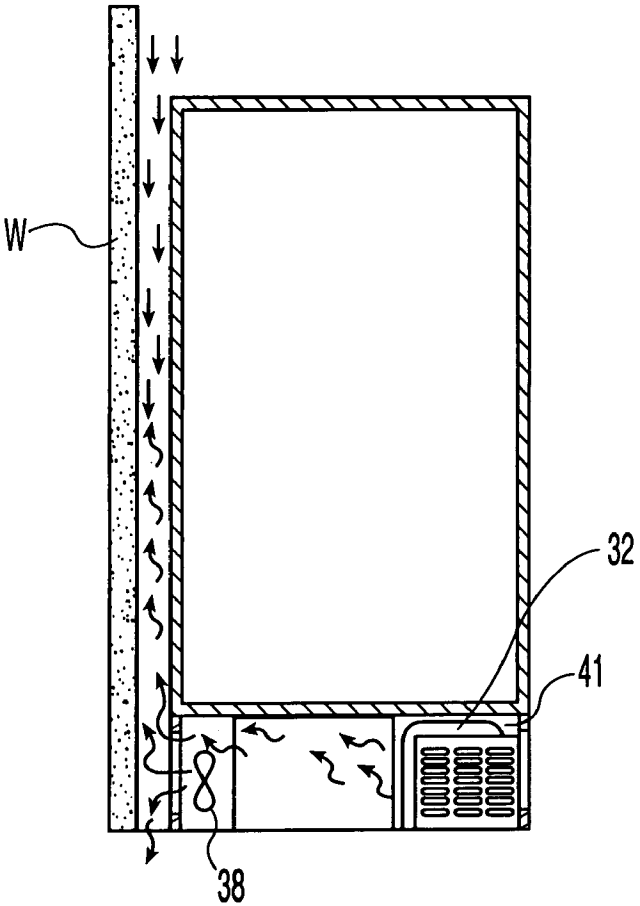
FIGS. 5 and 6 are side sectional views of a prior art refrigeration system.
Figure 5:
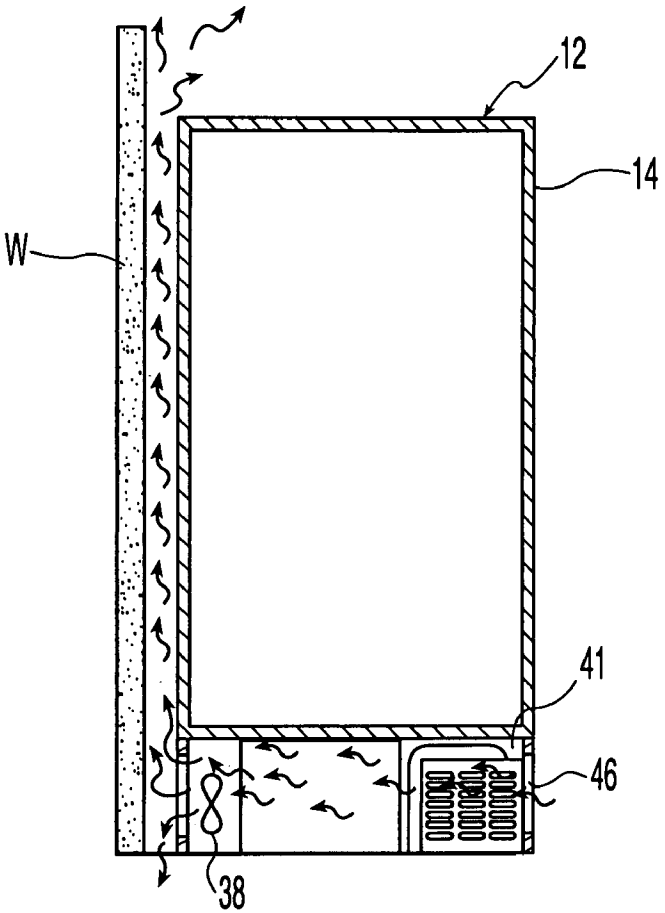

As illustrated in FIGS. 5 and 6, refrigeration systems are commonly positioned near a wall W of a building structure. Referring particularly to FIG. 5, when fan 38 is running, air is drawn into space 41 through air inlet 46 and is then forced out of space 41 and upward between wall W and outer wall 14 of cabinet 12, thereby dissipating any hydrocarbon refrigerant that might have leaked into space 41. When fan 38 is not running, as illustrated in FIG. 6, the temperature of the air in space 41 begins to rise due to the heat created by compressor 32. The warm air (represented by wavy arrows) then begins to rise between outer wall 14 of cabinet 12 and wall W. However, the contrastingly cool ambient air (represented by straight arrows) located above cabinet 12 begins to sink between wall W and outer wall 14. The sinking ambient air (straight arrows) counteracts the rising air (wavy arrows) from space 41, thereby preventing further upward movement of the air from space 41 and, ultimately, preventing the dissipation of any hydrocarbon refrigerant that might have leaked into space 41.

Referring back to FIGS. 1 and 2, to vent space 41 and flush out any hydrocarbon refrigerant, refrigeration system 10 includes convection channel 26. Convection channel 26 is disposed between outer wall 14 and inner wall 16 of cabinet 12 and extends from upper portion 22 of cabinet 12 to lower portion 24 of cabinet 12. Channel 26 communicates with the air outside upper portion 22 of cabinet 12 by extending at one end through outer wall 14 at the top of cabinet 12. Channel 26 communicates at its opposite end with space 41 within housing 40 by extending through outer wall 14 at the bottom of cabinet 12. Channel 26 is positioned at a distance d from inner wall 16 and has a width or diameter D. Channel 26 is cooled by transferring heat to nearby cooled interior 20 of cabinet 12.

In operation, cool ambient air from outside upper portion 22 of cabinet 12 sinks into channel 26 where it is further cooled by nearby interior 20. As the air within channel 26 cools, its density increases. The dense cool air in channel 26 overcomes the warm buoyant air from space 41, thereby forming a downward draft or flow through channel 26, as illustrated in FIG. 2.

Figure 8:
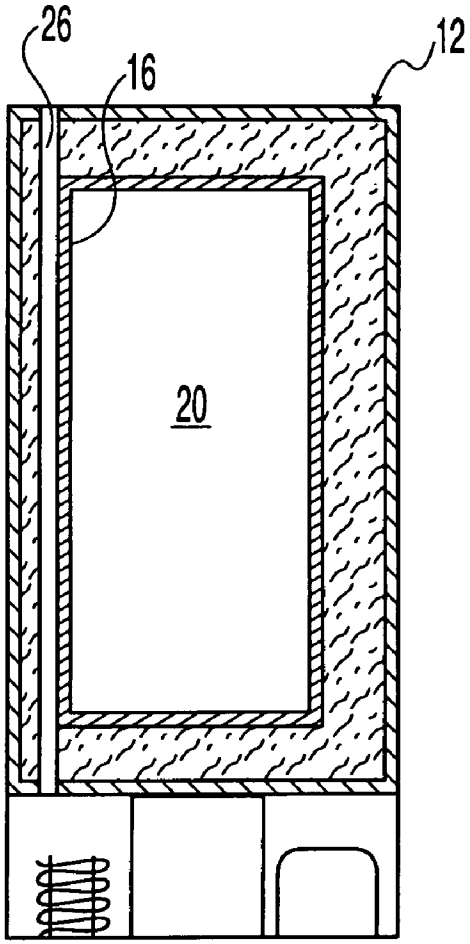
FIG. 8 is a front sectional view of another embodiment of a refrigeration system in accordance with the present invention.

To facilitate the cooling of the air within channel 26 and, thereby, the downward draft of air through channel 26, channel 26 is positioned from inner wall 16 at distance d, which is no greater than that which would allow adequate cooling of channel 26. More particularly, positioning channel 26 within about 1.905 centimeters (¾ inch) of inner wall 16 achieves effective cooling of the air within channel 26 and sufficient downward airflow. As shown in FIG. 8, channel 26 may be located directly adjacent inner wall 16 such that the wall of channel 26 abuts the inner wall 16 of cabinet 12. This direct thermal contact between inner wall 16 and channel 26 further facilitates the transfer of heat from channel 26 to interior 20 and, ultimately, the cooling of the air within channel 26.

Figure 7:
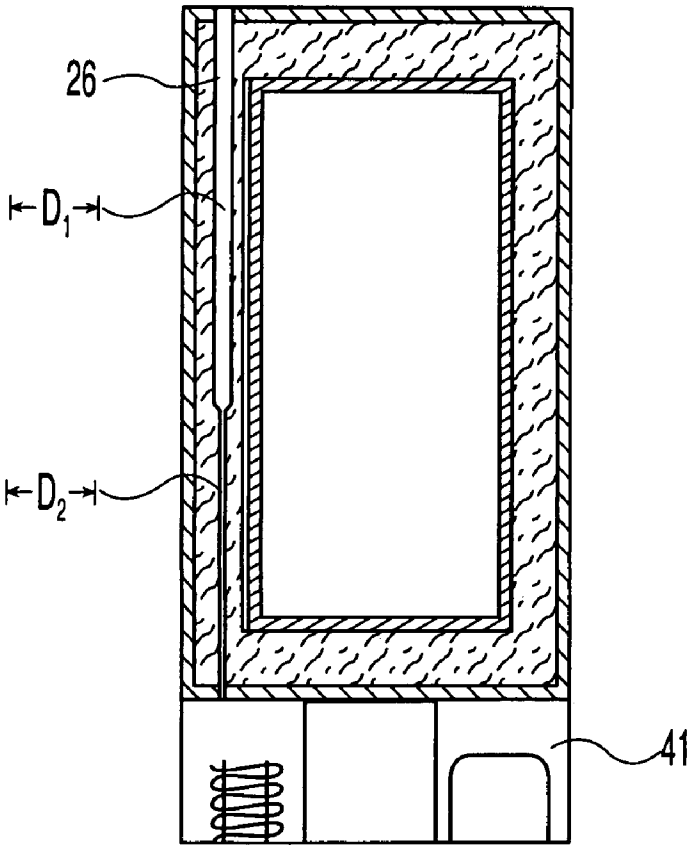
FIG. 7 is a front sectional view of another embodiment of the refrigeration system in accordance with the present invention.

To further facilitate the efficient and effective downward flow of air through channel 26, channel diameter D should be large enough to allow effective downward flow, but not so large as to require an inefficient and unnecessarily large amount of heat transfer into interior 20. Channel diameters D falling between 0.3175 cm and 2.54 cm (⅛" and 1") achieves effective and efficient cooling and airflow. As shown in FIG. 7, channel 26 may include multiple diameter portions, $D_1$, $D_2$. Channel 26 includes an upper portion having diameter $D_1$ and a lower portion having smaller diameter $D_2$. The larger diameter $D_1$ of the upper portion of channel 26 insures sufficient cooling of the ambient air entering channel 26. The smaller diameter $D_2$ of the lower portion of channel 26 reduces the amount of warm air that rises up from space 41 into channel 26.

Figure 10:
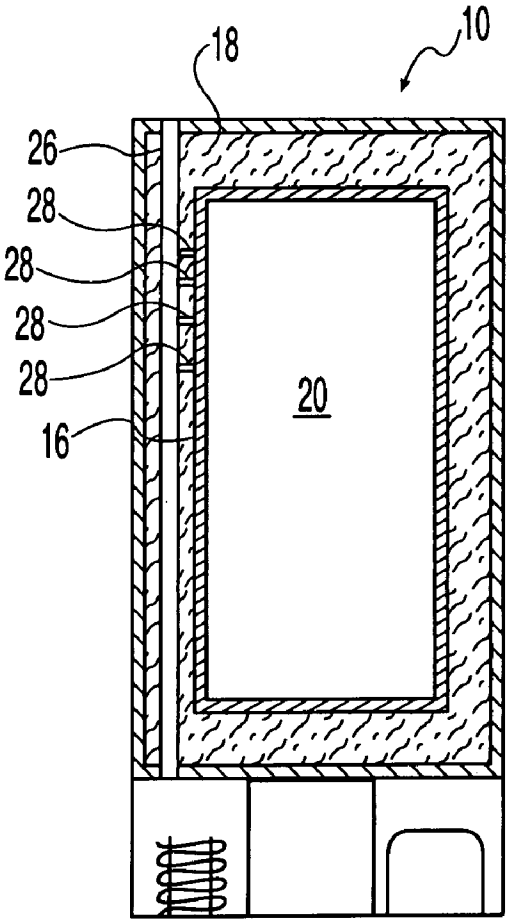
FIG. 10 is a front sectional view of another embodiment of a refrigeration system in accordance with the present invention.
Figure 9:
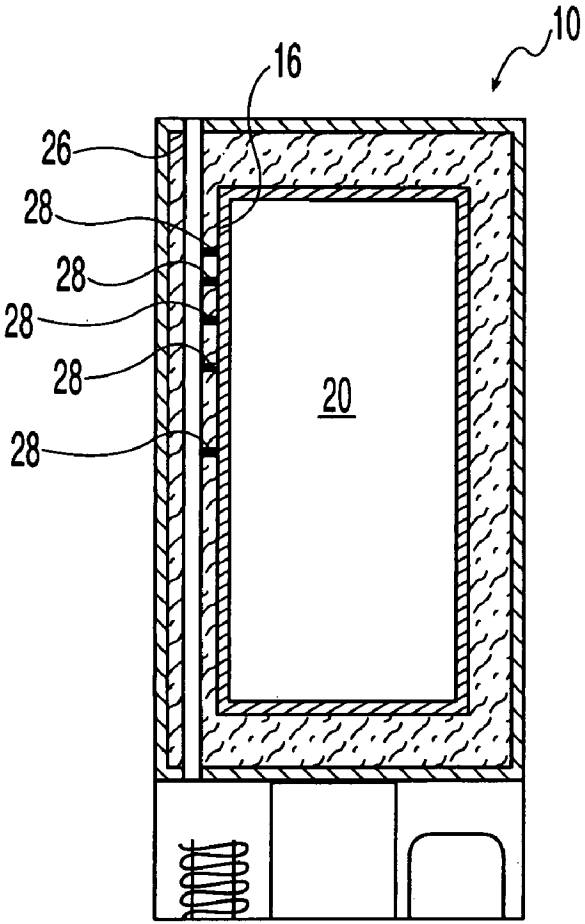
FIG. 9 is a front sectional view of another embodiment of a refrigeration system in accordance with the present invention.

As shown in FIGS. 9 and 10, refrigeration system 10 may also include one or more thermal bridges 28 extending from inner wall 16 of cabinet 12 to channel 26. Thermal bridges 28 facilitate the heat transfer from channel 26 to interior 20, thereby more effectively cooling the air within channel 26. As shown in FIG. 9, thermal bridges 28 can be comprised of a conductive material, such as aluminum, copper and/or steel. Alternatively, as shown in FIG. 10, thermal bridges 28 may comprise a gap in insulative material 18 between channel 26 and inner wall 16.

Figure 11:
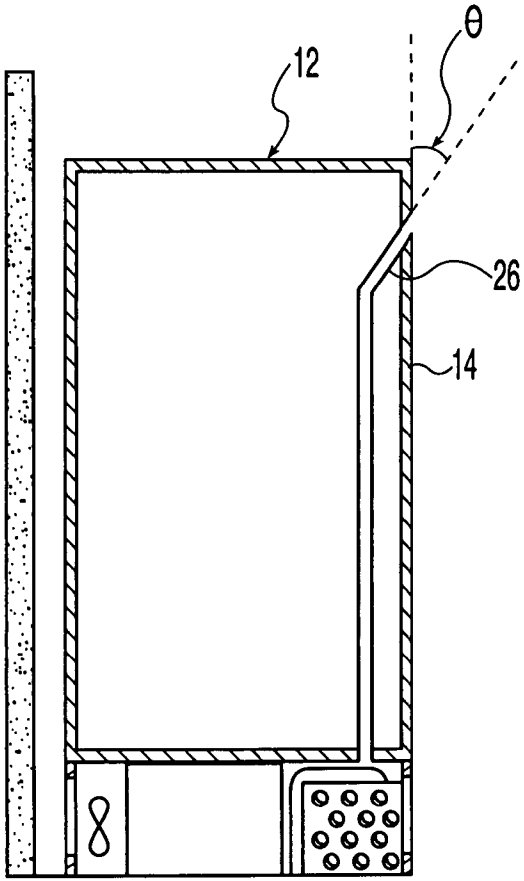
FIG. 11 is a side sectional view of another embodiment of a refrigeration system in accordance with the present invention.

Turning now to FIG. 11, channel 26 need not necessarily extend through outer wall 14 at the top of cabinet 12, as shown in FIGS. 1–2 and 7–10. Instead, channel 26 can penetrate outer wall 14 at the upper side of cabinet 12, as shown in FIG. 11. In this particular embodiment, channel 26 includes an angled portion which is angled relative to the outer wall 14. To avoid restricting air flow through channel 26, the angle θ of the channel should be no greater than 75° with respect to the vertical.

Figure 12:
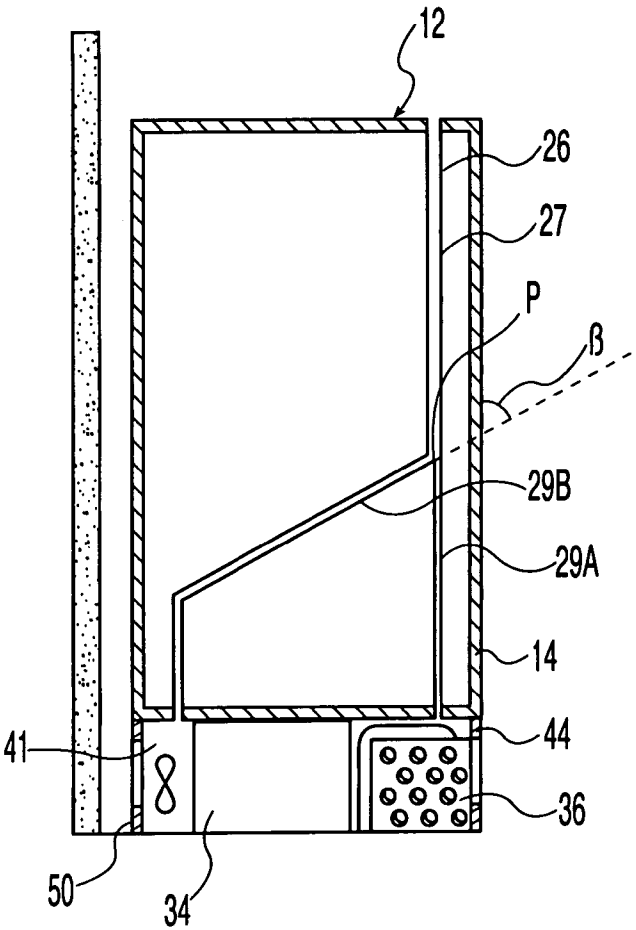
FIG. 12 is a side sectional view of another embodiment of a refrigeration system in accordance with the present invention.

Referring now to FIG. 12, channel 26 may also be branched to allow the venting of multiple locations in space 41. As shown in FIG. 12, channel 26 includes primary branch 27, which extends from the top of cabinet 12 to a junction point P; and two secondary branches 29A, 29B, which extend from junction point P to the bottom of cabinet 12. Secondary branches 29A, 29B penetrate outer wall 14 at the bottom of cabinet 12 in two different locations. Particularly, secondary branch 29A pierces outer wall 14 near front wall 44 just above condenser 36 to vent the condenser coils, while secondary branch 29B pierces outer wall 14 near back 50 to vent space 41 near evaporator 34. It should be understood that channel 26 can include any number of secondary branches extending to a variety of different locations in space 41. In addition, secondary branches 29A, 29B can extend at any angle with respect to the vertical, provided that the angle does not restrict the flow of air. More particularly, secondary branch angles β measuring 75° or less with respect to the vertical achieve adequate airflow.

Figure 13:
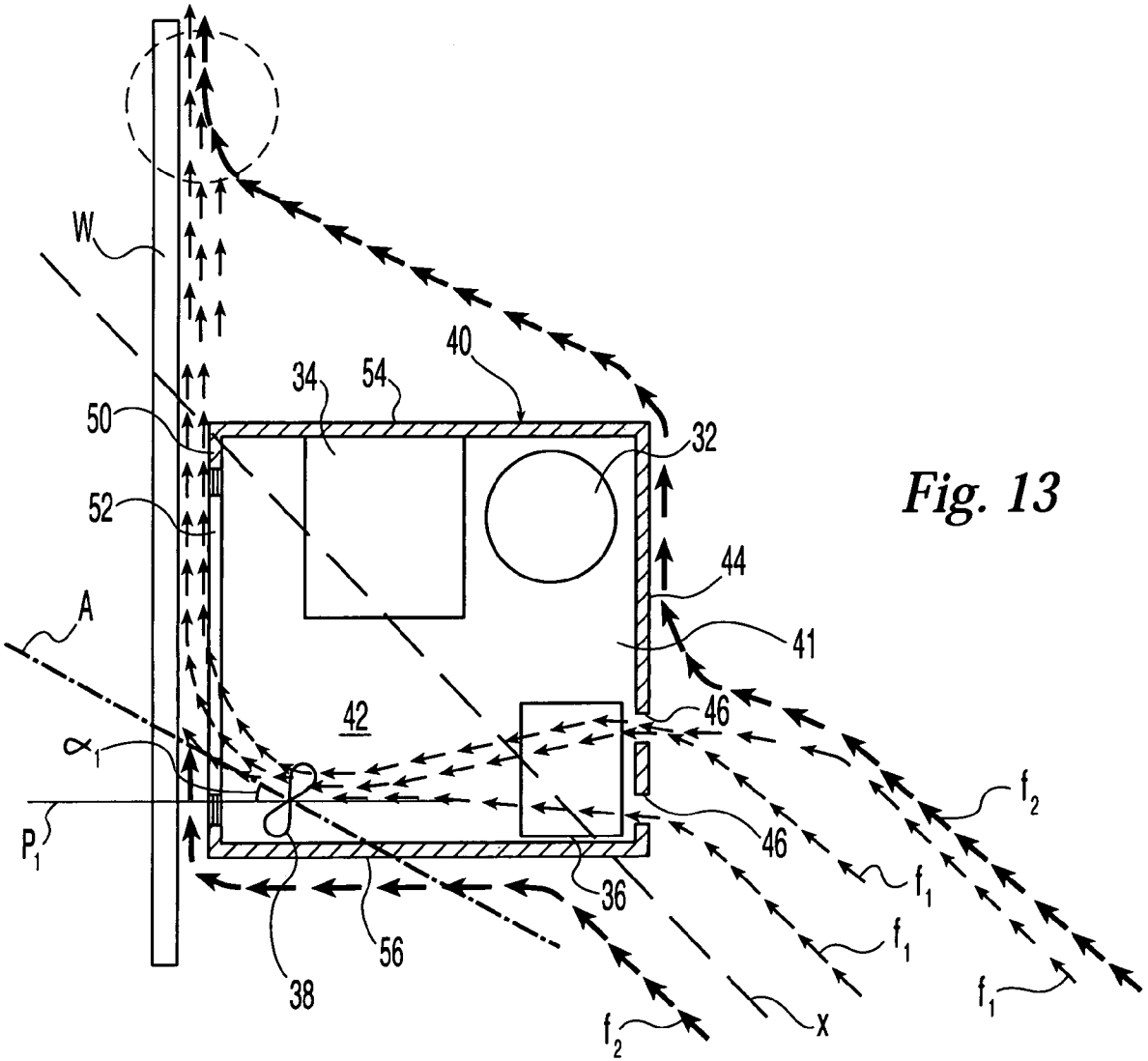
FIG. 13 is a top view of a cooling system according to one embodiment of the present invention.
Figure 14:
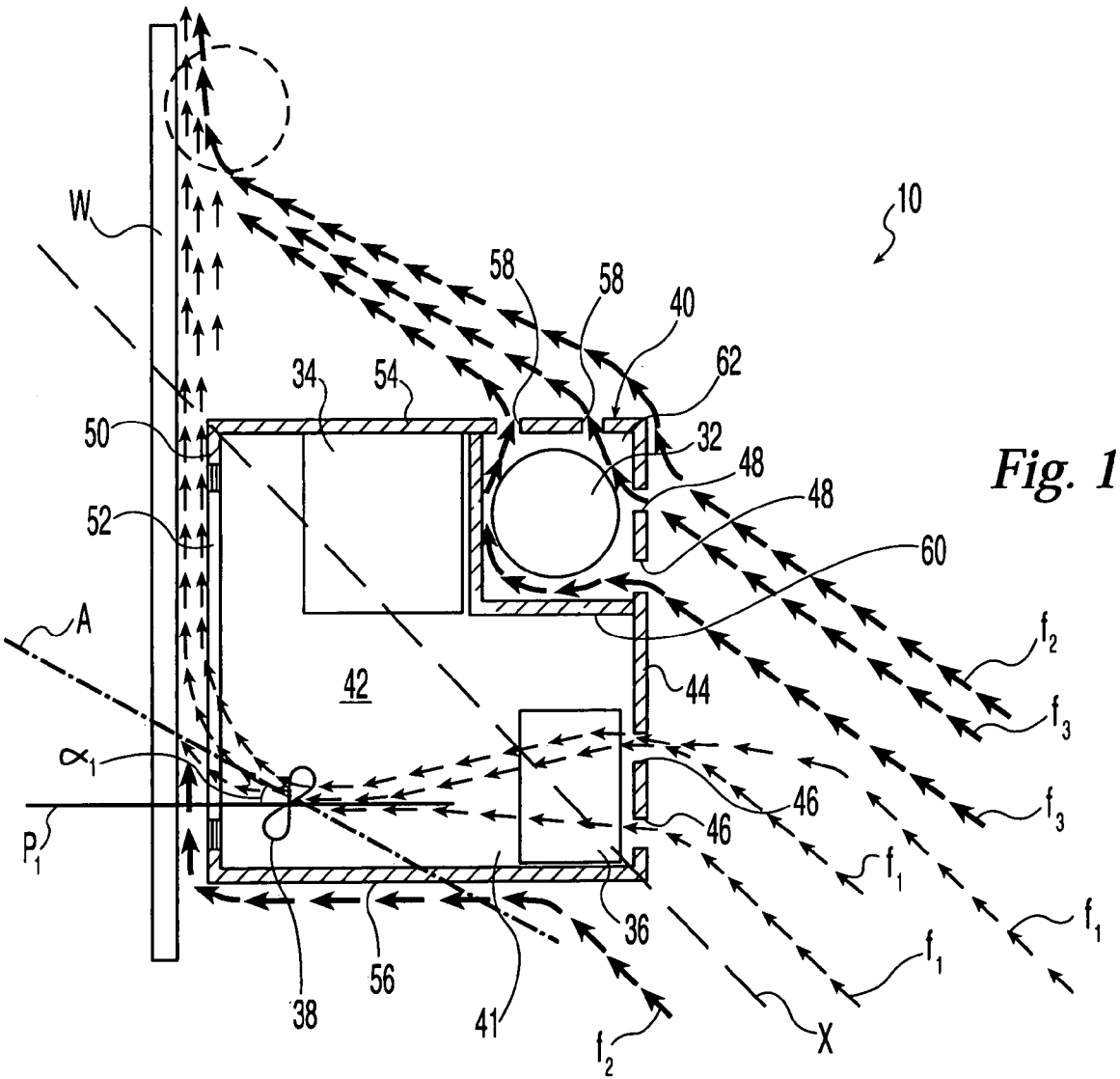
FIG. 14 is a top view of a cooling system in accordance with another embodiment of the present invention.

In another embodiment of the present invention illustrated in FIGS. 13 and 14, fan 38 is positioned within housing 40 such that the axis A of fan 38 is aligned along a vertical plane that defines a non-perpendicular angle $\alpha_1$ relative a vertical plane $P_1$ aligned perpendicular to back 50 of housing 40. Referring particularly to FIG. 13, fan 38 creates a first horizontal air flow $f_1$ in which air is drawn into housing 40 through first air inlet 46 and forced out of housing 40 through first air outlet 52 in a direction non-perpendicular to back 50. Fan 38 directs the exiting first horizontal air flow $f_1$ in one horizontal direction between wall W and back 50 of housing 40. First horizontal airflow $f_1$ then mixes with ambient air, thereby diluting and dissipating any hydrocarbon refrigerant.

First horizontal air flow $f_1$, in turn, engages the air outside housing 40 and induces a second horizontal air flow $f_2$ in a direction substantially parallel to the diagonal X of base 42. In other words, second horizontal air flow $f_2$ flows about housing 40 in a direction that is non-perpendicular to housing 40. The non-perpendicular direction of second horizontal air flow $f_2$ causes air flows $f_1$ and $f_2$ to meet and mix in a mixing region, which is represented by the encircled area in FIG. 13. This mixing of first and second horizontal air flows $f_1$ and $f_2$ further dilutes and dissipates any hydrocarbon refrigerant in first horizontal air flow $f_1$ to more effectively dilute the hydrocarbon refrigerant and maintain the hydrocarbon refrigerant concentration at a level below the Low Flammability Limit.

Figure 15:
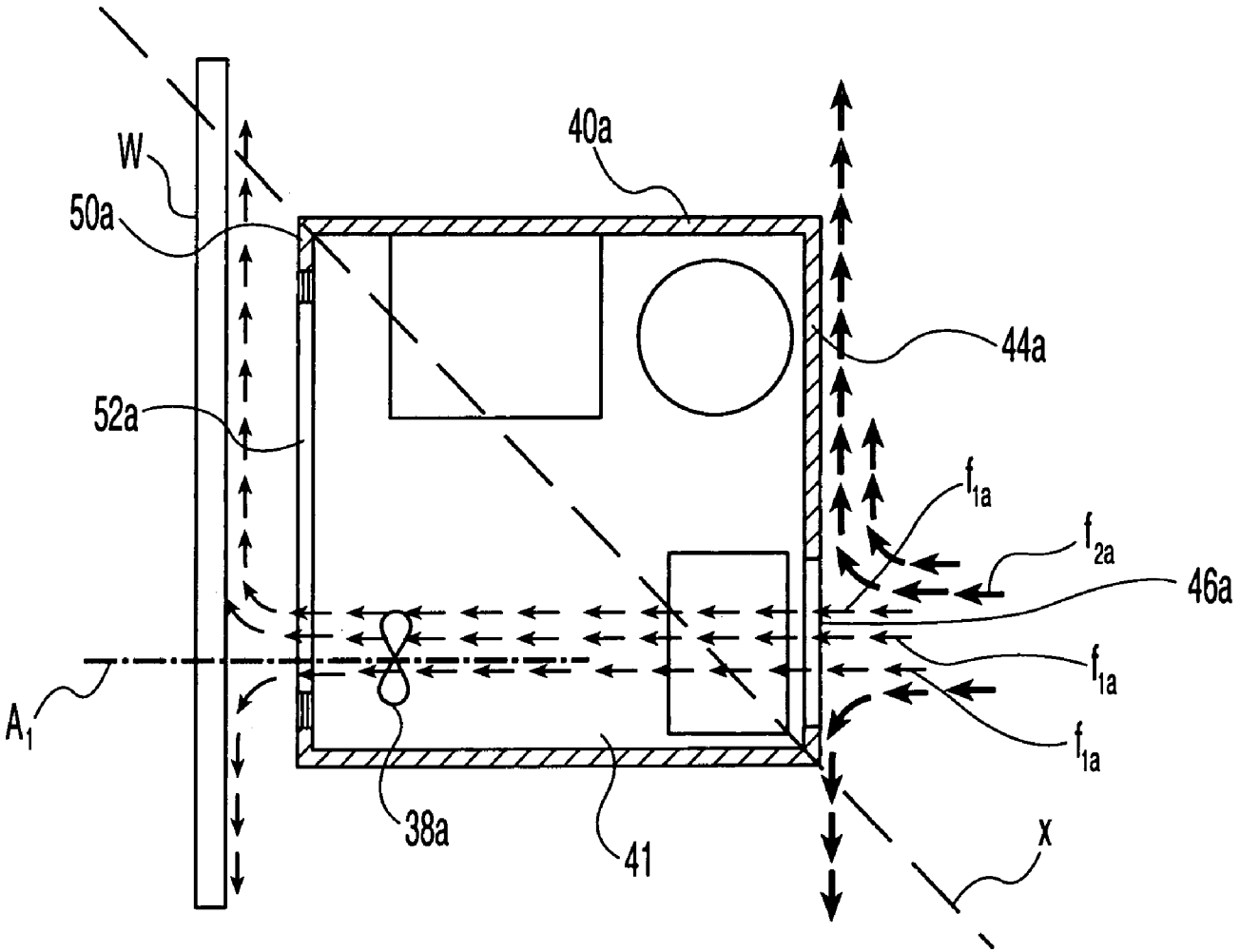
FIG. 15 is a top view of a cooling system of a prior art refrigeration system.

Referring now to FIG. 15, in prior refrigeration systems fan 38*a* is positioned with its axis A perpendicular to back 50*a*. In this configuration, fan 38*a* creates air flow $f_{1a}$ in which air is drawn into housing 40*a* through air inlet 46*a* and forced out through outlet 52*a* in a direction perpendicular to back 50*a*. The exiting air flow is deflected by wall W in both horizontal direction. Generally, first air flow $f_{1a}$ does not induce a substantial second air flow $f_{2a}$. However, the second air flow $f_{2a}$ that is induced does not flow in the direction of the housing diagonal. Instead, second air flow $f_{2a}$ encounters front wall 44*a* and is deflected in a direction parallel to wall 44*a*. Consequently, first and second air flows do not meet and do not further mix in a mixing region.

Referring back to FIG. 13, angle $\alpha_1$ of fan 38 can be any angle that is non-perpendicular to back 50. However, favorable air flow results are achieved when fan 38 is positioned such that non-perpendicular angle $\alpha_1$ is between about 5° and 75° relative to a vertical plane $P_1$ aligned perpendicular to the back 50 of housing 40.

Referring now to FIGS. 3, 4 and 14, refrigeration system 10 may include partition 60 which extends from front wall 44 to side wall 54 to create compressor enclosure 62. Compressor 32 may then be positioned within compressor enclosure 62 to shield the compressor, which includes electrical components having the potential of producing a spark, from the condenser, which is the component from which hydrocarbon refrigerant leaks most likely occur. In this arrangement the potential for combustion is reduced by physically separating the spark source from the leak source. Still referring to FIGS. 3, 4 and 14, housing 40 may also include a second air inlet 48 defined in front wall 44 and second air outlet 58 defined in side wall 54. Both second air inlet 48 and second air outlet 58 are in communication with the interior of compressor enclosure 62 to vent compressor 32. As noted above, second horizontal air flow $f_2$ flows about housing 40 in a direction non-perpendicular to housing 40. Second horizontal airflow $f_2$ induces a third horizontal airflow $f_3$, which enters compressor enclosure 62 through second air inlet 48 and exits compressor enclosure 62 through second air outlet 58, thereby cooling compressor 32.

Figure 16:
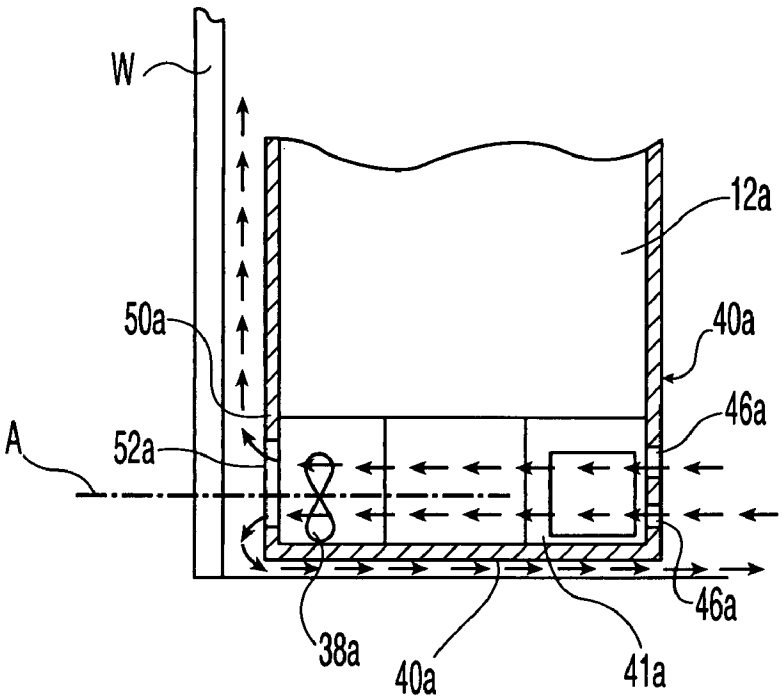
FIG. 16 is a side sectional view of a prior art refrigeration system.

Referring now to FIG. 16, in prior systems fan 38*a* is positioned such that a horizontal plane aligned along axis A defines a perpendicular angle relative to back 50*a*. In this configuration air flows into housing 40*a* through air inlets 46*a* and exits housing 40*a* through air outlets 52*a*. The air exiting housing 40*a* flows in a direction perpendicular to back 50*a* such that when the air meets the wall W it is deflected in both the upward and downward directions. The air flowing in the downward direction then flows under housing 40*a*. When the air exits the area beneath housing 40*a*, the air can be drawn back into housing 40*a* through air inlet 46*a*. Consequently, the air flowing downward never leaves the area beneath cabinet 12*a* and can be re-circulated back into space 41*a* of housing 40. This may ultimately result in a hydrocarbon refrigerant accumulation to a level above the Low Flammability Level.

Figure 17:
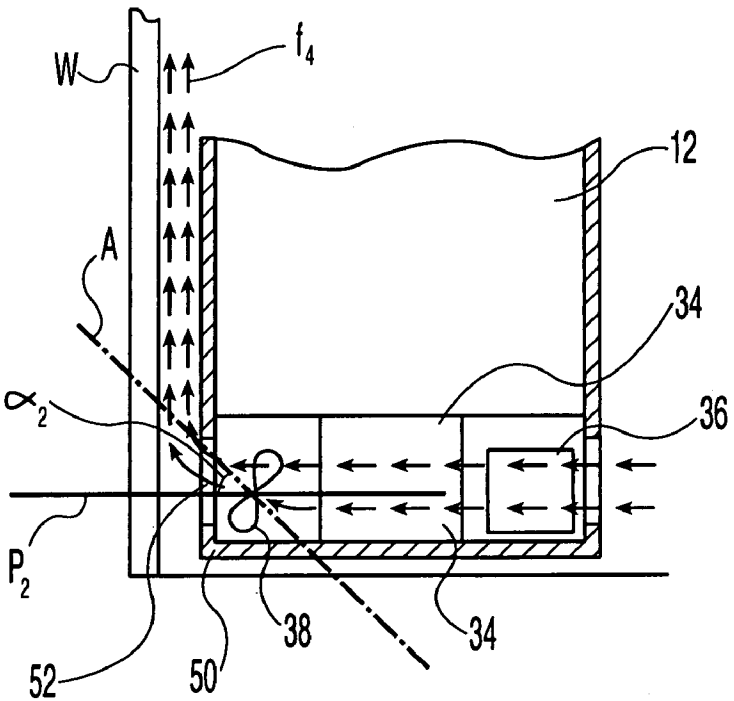
FIG. 17 is a side sectional view of another embodiment of a refrigeration system in accordance with the present invention.

Referring now to FIG. 17, according to the present invention, fan 38 may also be inclined, as shown in FIG. 17. More specifically, fan 38 may be positioned such that a horizontal plane aligned along axis A defines a second non-perpendicular angle $\alpha_2$ relative to a horizontal plane $P_2$ aligned perpendicular to back 50 of housing 40. In this embodiment fan 38 induces a vertical air flow $f_4$ in which air exiting first air outlet 52 is directed upward, thereby preventing the flow of air beneath housing 40 and preventing the re-circulation of air into housing 40. Angle $\alpha_2$ can be any angle non-perpendicular to horizontal plane $P_2$. However, favorable vertical air flow results are achieved when fan 38 is positioned such that a horizontal plane aligned along the axis A defines a non-perpendicular angle $\alpha_2$ of between about 15° and 65° relative to horizontal plane $P_2$, which is aligned perpendicular to back 50 of housing 40.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hydrocarbon cooling system comprising:

a housing including a substantially rectangular base defining a diagonal, a front wall defining a first air inlet, a back defining a first air outlet, and a pair of side walls;

a condenser mounted within said housing adjacent said first air inlet;

a compressor mounted within said housing;

an evaporator mounted within said housing; and a fan mounted within said housing and defining an axis, said fan positioned such that a vertical plane aligned along said axis defines a first a non-perpendicular angle relative to a second vertical plane aligned perpendicular to said back of said housing, said fan creating a first horizontal airflow path, said first horizontal airflow path entering said housing through said first air inlet of said front wall and exiting said housing through said first air outlet of said back of said housing to vent said condenser, said first horizontal airflow path inducing a second horizontal airflow, said second horizontal airflow path moving around said housing along a line substantially parallel to said diagonal.

2. The hydrocarbon cooling system of claim 1 wherein said first horizontal airflow path exits said housing in a direction non-perpendicular to said back.

3. The hydrocarbon cooling system of claim 1 wherein said fan is mounted near said back of said housing and is spaced apart from said condenser.

4. The hydrocarbon cooling system of claim 1 wherein said first non-perpendicular angle is between about 5° and 75°.

5. The hydrocarbon cooling system of claim 1 wherein said fan is further positioned such that a horizontal plane aligned along said axis defines a second non-perpendicular angle relative to a second horizontal plane aligned perpendicular to said back of the housing.

6. The hydrocarbon cooling system of claim 5 wherein said second non-perpendicular angle is between about 15° and 65°.

7. The hydrocarbon cooling system of claim 5 wherein said fan creates a vertical airflow path, said vertical airflow path forcing air exiting from said first air outlet upward, thereby preventing a downward flow of air from said air outlet.

8. The hydrocarbon cooling system of claim 1 wherein said housing further includes a partition, said partition isolating said compressor from said condenser and said evaporator.

9. The hydrocarbon cooling system of claim 8 wherein said front wall further defines a second air inlet spaced apart from said first air inlet; wherein one of said pair of sidewalls defines a second air outlet; and wherein said compressor is positioned adjacent both said second air inlet and said second air outlet, said partition extending from said front wall to said one of said pair of sidewalls thereby isolating said compressor, said second air inlet and second air outlet from said first air inlet and said first air outlet.

10. The hydrocarbon cooling system of claim 9 wherein said second horizontal airflow path induces a third horizontal airflow path, said third horizontal airflow path entering said housing through said second air inlet of said front wall and exiting said housing through said second air outlet of said one of said pair of sidewalls to vent said compressor.

11. A hydrocarbon cooling system comprising:

a housing including a substantially rectangular base, a front wall extending upwardly from said base and defining a first air inlet and a second air inlet, a back defining a first air outlet, a first sidewall extending upwardly from said base and defining a second air outlet, and an opposite second sidewall extending upwardly from said base;

a condenser mounted within said housing adjacent said first air inlet;

a compressor mounted within said housing adjacent both said second air inlet and said second air outlet;

an evaporator mounted within said housing;

a fan mounted within said housing and defining an axis, said fan creating a first horizontal airflow path, said first horizontal airflow path entering said housing through said first air inlet and exiting said housing through said first air outlet to vent said condenser; and a partition mounted within said housing and extending upwardly from said base, said partition extending from said front wall between said first and second air inlets to said first sidewall, wherein said partition encloses said compressor and isolates said compressor, said second air inlet and said second air outlet, collectively, from said condenser, said first air inlet and said first air outlet.

12. The hydrocarbon cooling system of claim 11 wherein said fan is positioned such that a vertical plane aligned along said axis defines a first a non-perpendicular angle relative to a second vertical plane aligned perpendicular to said back of said housing.

13. The hydrocarbon cooling system of claim 12 wherein said first non-perpendicular angle is between about 5° and 75°.

14. The hydrocarbon cooling system of claim 12 wherein said first horizontal airflow path exits said housing in a direction non-perpendicular to said back.

15. The hydrocarbon cooling system of claim 12 wherein said first horizontal airflow path induces a second horizontal airflow, said second horizontal airflow path moving around said housing along a line non-perpendicular to said housing.

16. The hydrocarbon cooling system of claim 15 wherein said second horizontal airflow path induces a third horizontal airflow path, said third horizontal airflow path entering said housing through said second air inlet of said front wall and exiting said housing through said second air outlet of said one of said pair of sidewalls to vent said compressor.

17. The hydrocarbon cooling system of claim 11 wherein said fan is positioned such that a horizontal plane aligned along said axis defines a second non-perpendicular angle relative to said back of the housing.

18. The hydrocarbon cooling system of claim 17 wherein said second non-perpendicular angle is between about 15° and 65°.

19. The hydrocarbon cooling system of claim 17 wherein said fan creates a vertical airflow path, said vertical airflow path forcing air exiting from said first air outlet upward, thereby preventing a downward flow of air from said air outlet.

20. A method of venting hydrocarbon refrigerant leaks from the housing of a hydrocarbon cooling system having a compressor disposed within the housing, a condenser disposed within the housing and spaced apart from the compressor, and an evaporator disposed within the housing, comprising the steps of:

creating a first airflow path through the housing by mounting a fan within the housing, the first airflow path entering the housing through an air inlet located in the front of the housing and exiting the housing through an air outlet located in the back of the housing;

venting the condenser by positioning the condenser adjacent the air inlet and in the first airflow path; and inducing a second airflow path about the housing by positioning the fan such that an axis of the fan lies along a vertical plane defining a first non-perpendicular angle relative to a second vertical plane aligned perpendicular to a back of the housing, the second airflow path moving along a line non-perpendicular to the housing.

21. The method of claim 20 further comprising the step of isolating the compressor from the condenser and the first airflow path by mounting a partition within the housing, the partition extending from the front of the housing to a side of the housing to create a compressor enclosure, and positioning the compressor within the compressor enclosure.

22. The method of claim 21 further comprising the step of venting the compressor enclosure including the steps of:

defining a second air inlet in the front of the housing adjacent the compressor, the second air inlet in communication with the compressor enclosure and isolated from the condenser and the first airflow path by the partition;

defining a second air outlet in a side of the housing adjacent the compressor, the second air outlet in communication with the compressor enclosure and isolated from the condenser and the first airflow path by the partition; and providing a third airflow path through the compressor enclosure by using the second airflow path to induce the third airflow path, the third airflow path entering the compressor enclosure through the second air inlet and exiting the enclosure through second air outlet.

23. The method of claim 22 further comprising the step of creating a vertical airflow path by positioning the fan such that the axis of the fan lies along a horizontal plane defining a second non-perpendicular angle relative to the back of the housing, the vertical airflow path moving air exiting the air outlet upward.

* * * * *